US006676123B2

(12) United States Patent
Sahlmann

(10) Patent No.: US 6,676,123 B2
(45) Date of Patent: Jan. 13, 2004

(54) DEVICE FOR IMPROVING THE ALIGNMENT ACCURACY OF SHEET-LIKE MATERIAL

(75) Inventor: Jürgen Sahlmann, Ellerdorf (DE)

(73) Assignee: NexPress Solutions LLC, Rochester, NY (US)

( * ) Notice: Subject to any disclaimer, the term of this patent is extended or adjusted under 35 U.S.C. 154(b) by 66 days.

(21) Appl. No.: 09/850,326

(22) Filed: May 7, 2001

(65) Prior Publication Data

US 2003/0042670 A1 Mar. 6, 2003

(30) Foreign Application Priority Data

May 16, 2000 (DE) ..... 100 23 693

(51) Int. Cl.[7] ..... B65H 9/00
(52) U.S. Cl. ..... 271/227; 271/228
(58) Field of Search ..... 271/226, 227, 271/228

(56) References Cited

U.S. PATENT DOCUMENTS 2,140,006 A 12/1938 Goodwin ..... 271/58
2,300,625 A 11/1942 Martin
5,078,384 A * 1/1992 Moore ..... 271/228
5,156,391 A * 10/1992 Roller ..... 271/227
5,169,140 A * 12/1992 Wenthe, Jr. ..... 271/228
5,564,544 A 10/1996 Takemoto et al. ..... 194/206
5,918,876 A * 7/1999 Maruyama et al. ..... 271/228

FOREIGN PATENT DOCUMENTS

DE 12 56 449 12/1967
DE 44 16 564 A1 11/1994
EP 0579 057 A1 1/1994 ..... B65H/9/16
EP 0848 357 A1 6/1998 ..... G07D/9/00

OTHER PUBLICATIONS

JP 0057156939 AA.,In: Patent Abstracts of Japan; *Aligning Device of Paper*, Sep. 28, 1982.

* cited by examiner

*Primary Examiner*—David H. Bollinger
(74) *Attorney, Agent, or Firm*—Lawrence P. Kessler

(57) ABSTRACT

An aligning unit (8) for sheet like material (1), such sheet-like material being aligned by rotation elements (25), (34) with respect to the conveying direction (22) through a machine processing such sheet-like material (1) before the passage to a conveying plane (9). The sheet-like material (1) is contacted, on at least one side, by the rotation elements (25), (34). The rotation elements include segmented rollers respectively having a roller core (38), and a ring-shaped coating (35). The area of contact (36), (44) between the sheet-like material (1) and the segmented rollers (25) is minimized.

7 Claims, 4 Drawing Sheets

DEVICE FOR IMPROVING THE ALIGNMENT ACCURACY OF SHEET-LIKE MATERIAL

FIELD OF THE INVENTION

The invention concerns a device for improving the alignment accuracy in the case of a sheet-like material which, before further processing is aligned in a conveying plane positionally precisely with respect to its twisted position and its oblique position with respect to the machine direction.

BACKGROUND OF THE INVENTION

U.S. Pat. No. 5,322,273, issued Jun. 21, 1994 in the name of Rapkin, et al., is directed to a sheet aligning device. This device for aligning a sheet moving along an essentially plane conveying path makes possible the alignment of a moving sheet in a number of orthogonal directions, for example transverse to the conveying path and in the direction of the conveying path, and for eliminating inclined positions.

The device has a first roller arrangement with a first backup roller, which is mounted so that it can turn around an axis, which lies in a plane extending parallel to the plane of the conveying path, and passes essentially at a right angle to the direction of sheet transport along the conveying path. A second roller arrangement has a second backup roller, which is mounted so that it can turn around an axis which lies in a plane extending parallel to the plane of the conveying path and passes essentially at a right angle to the direction of the sheet transport along the transport path. A third roller arrangement is provided which has a third backup roller, which is mounted so that it can turn around an axis, which lies in a plane extending parallel to the plane of the conveying path, and essentially at a right angle to the direction of the sheet transport along the conveying path. A third roller arrangement, which is capable of turning around an axis which lies in a plane extending parallel to the direction of sheet transport, is movable along its rotational axis in a direction passing transverse to the conveying path.

Finally, a control device is provided which is in an operating connection with the first, respectively second, respectively third arrangement, and optionally controls the rotation of the first and second roller arrangement, in order to align the leading edge of a sheet moving in a position located at a right angle to the direction of sheet transport along the conveying path. Further, the control direction controls the rotation and transverse motion of the third roller arrangement, in order to align the sheet moving in the direction passing transverse to the direction of the sheet transport as well as the direction in which the sheet moves along the conveying path.

The sheet alignment device known from U.S. Pat. No. 5,322,273 made it possible to satisfy the required alignment accuracy only to a limited degree. In order to achieve the required alignment accuracy, a comprehensive modification to the currently known sheet alignment device is necessary, which does not appear to be economical.

In the case of sheet-processing printing presses functioning according to the offset principle, the sheets are conveyed to the feed table in a overlapping arrangement, before they are aligned to side and pull guides provided in the level of the feed table. After successful alignment of the sheet-like material the latter is transferred to a preliminary gripper in the aligned condition, which accelerates the sheet-like material to machine speed and transfers it to a curved cylinder placed after the preliminary gripping device. Other alignment concepts for the most part use a cylindrical roller which has a rubber coating applied to the roller core. If an alignment of sheet-like material during the advance thereof is made by changing the speed between a left and right roller gripping the sheet-like material with such a configuration, the sheet-like material experiences a rotation around a turning point, which is located on the stationary roller, or during the advance is located outside the roller with the lower speed or between the two rollers. The actual point of contact between the sheet-like material and the roller is not defined; it is known only that it is located within the roller width. This uncertainty has an effect on the quality of the alignment result.

SUMMARY OF THE INVENTION

The object of the invention is to considerably improve the alignment accuracy of sheet-like material during the advance thereof in the direction of sheet travel.

According to the invention this object is achieved by the features of Patent claim 1.

The advantages attainable with the solution according to the invention are to be seen above all in the fact that the smallest possible contact surface is created between upper side of the sheet-like material to be aligned and the contact surface of the alignment element because of the geometrical shape of roller core surfaces, respectively elastic coatings applied thereto, such as, for example, rubber coatings. Thus the point of contact between printing material and roller is known or at least defined essentially more accurately as compared with the solutions known from the prior art, so that the quality of the alignment can be improved considerably. The more dimensionally stable the elastic material used for alignment can be made, the smaller the contact surface, which in each case is in contact with the surface of the sheet-like material, can be made.

In an advantageous embodiment of the concept underlying the invention, the aligning elements can be made as rollers, that is, as rotation-symmetrical bodies, which include a roller core as well as a ring-shaped coating material applied thereto. Thus, for example, the roller core can be made out of an inexpensive material, compared with the ring-shaped coating material applied thereto, further in this way it is possible to make the roller core more easily and the shape of the ring-shaped coating specifically.

In one embodiment, the ring-shaped coating on the peripheral surface of the roller core can be applied as a liquid under pressure. In this embodiment the ring surface can be made, for example as an endless ring, which can be secured simply on the peripheral surface of the roller core. The coating also can be glued or cast onto the surface of the roller.

In a second embodiment, the ring-shaped coating on the peripheral surface of the roller core can be applied positively, for example with a shrink fit, to lock to the roller core. Preferably the annularly configured coating is made in one piece, so that no interruptions, but a continuous surface, can be made on the circumference of the roller core. The annular coating can be provided, for example, with a trapezoidal cross-section, which is distinguished in particular by a narrow and sharp-edged contact area between gently tapering edges for the upper side of the sheet-like material. The more point-like, the contact can be made, the more exactly can alignment results be achieved with the solution according to the invention.

If ring-like coatings are applied to the peripheral surfaces of the roller core, recesses for holding of these support elements can be included in the surfaces of the roller cores. The contact elements aligning the sheet-like material can be made in the surfaces of the roller cores as annular longitudinal grooves, thus ensuring support of the support elements to be introduced into this recess on the lateral surfaces thereof.

In order to eliminate the danger of damage to the contact areas between sheet-like material and the alignment elements, the latter are configured as narrow rings or as trapezoidal surfaces, and can be made as an elastic flexible material.

In a preferred use of the solution proposed according to the invention, in order to improve the alignment accuracy the latter can be placed in an aligning unit which can be located in front of a press, for example a sheet-processing printing press. The solution according to the invention can be used in aligning units which also can be used on digitally operating rotary printing presses, since the printing material processed there, be it films, cardboard, paper, or the like, also needs alignment before it is printed or, in a given case, processed in a digitally operating machine.

The invention, and its objects and advantages, will become more apparent in the detailed description of the preferred embodiment presented below.

BRIEF DESCRIPTION OF THE DRAWINGS

The invention is explained in greater detail below by reference in the accompanying drawings, in which.

DETAILED DESCRIPTION OF THE INVENTION

Figure 1:
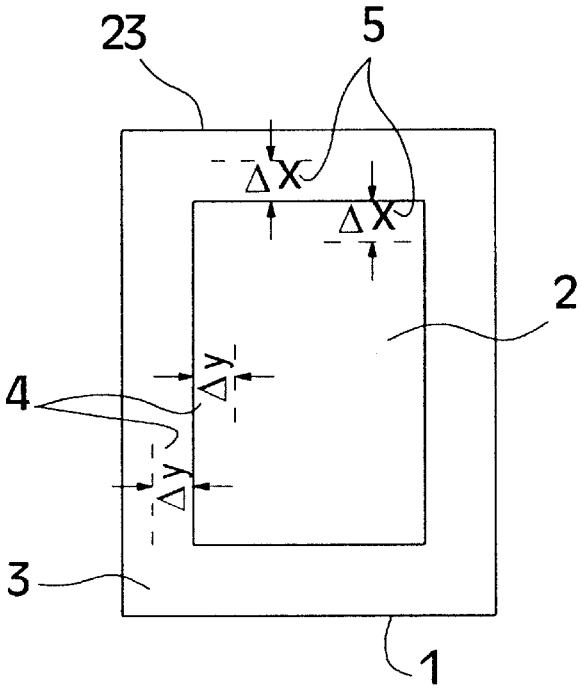
FIG. 1 shows a position deviation of a printed image which occurs relative to the printing material surface receiving the image.

A rectangular oriented sheet-like material, for example a printing sheet 1, follows from the representation given in FIG. 1. The printing sheet 1 contains on its surface a printed image 2, which is surrounded by a frame-like edge 3. The deviations of $\Delta x$, respectively $\Delta y$, marked within the printing surface 2 and the frame 3, designating the position errors in the x and y directions 4, respectively 5, can appear at the time of printing the image 2 onto the surface of the sheet 1. The deviations, designated with reference plumbers 4, respectively 5, are position deviations, whereas in the representation shown in FIG. 2, angular deviations of the printed image 2 are shown with respect to their position on the printing sheet 1.

Figure 2:
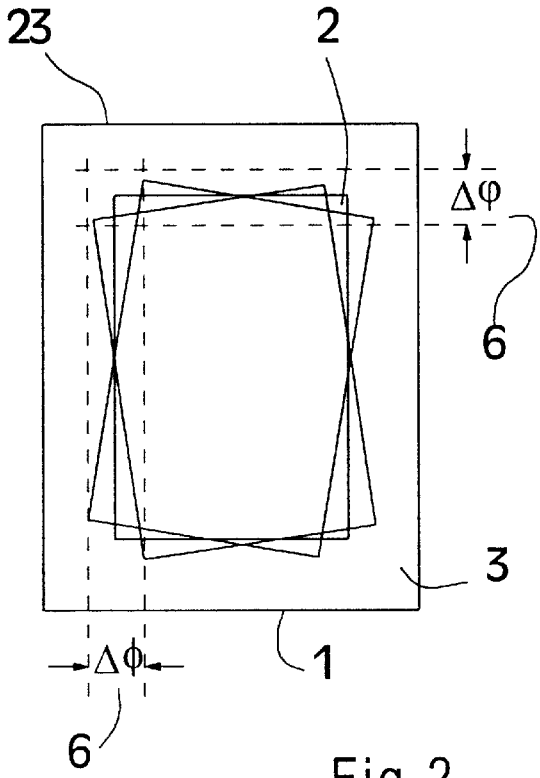
FIG. 2 shows an offset of the printing image on the sheet-like material, characterized by a rotational offset.

The angular errors $\Delta\phi$ and $\Delta\phi$ which occur are designated with reference numbers 6 in the representation shown in FIG. 2. The printing image 2 can be printed in the indicated position onto the surface of the printing material, the latter being conveyed in the direction of feed 22 with its leading edge 23.

Figure 3:
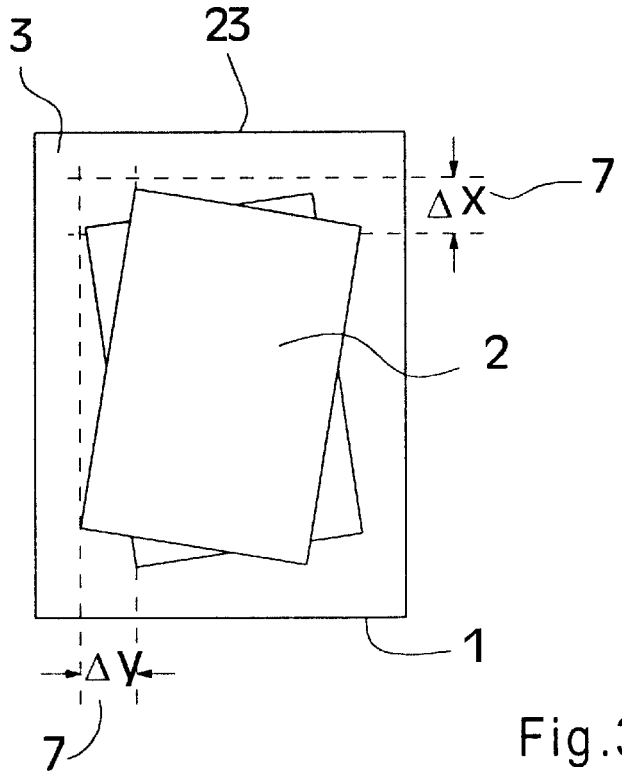
FIG. 3 shows an offset of the printing image printed on the underside of a sheet-like material in first and perfecting form.

The representation given in FIG. 3 in a schematic view shows the turning register, the offsets which occur in each case between the printed images 2 on the front and back side of the sheet-like material 1, being indicated with reference numbers 7. These are designated in the representation shown in FIG. 3 with reference numbers 7, respectively with $\Delta x$ and $\Delta y$. The turning register plays a role, in particular in the case of transparent types of paper as well as in brochure printing.

Figure 4:
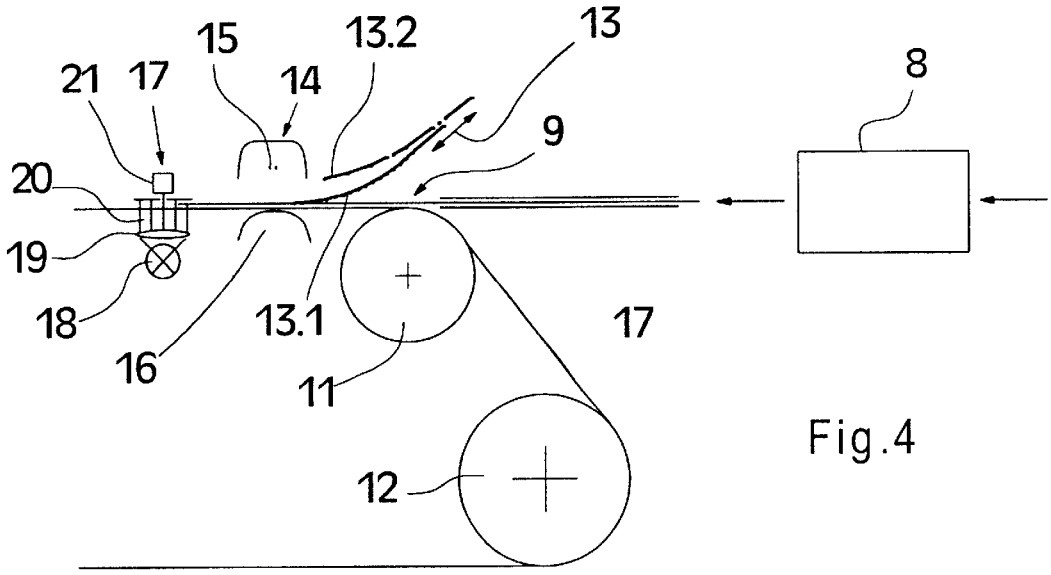
FIG. 4 shows the side view of a sheet intake area of a sheet-processing machine in a schematic representation.

The interface of sheet alignment and feeding onto a conveyor belt in a schematically presented side view follow from FIG. 4.

An aligning unit 8 is connected in front of a conveyor belt 10, onto the surface of which the sheet-like material 1 is applied in the conveying plane 9. The belt 10 revolves around a roller 11 and a control roller 12. After passing through the aligning unit 8, which is described in greater detail below, the aligned sheet-like material 1 reaches the surface of the conveyor belt 10 in the conveying plane 9. After passing the roller 1, the sheet-like material 1 is acted upon by an adjusting flap or adjusting lip, which is movable in the adjusting direction 13. The adjusting lip or adjusting flap can be a plastic component, which can be brought from one adjusted position 13.1 into an adjusted position 13.2, which is shown here only schematically in solid or dashed lines. By the adjusting flap or adjusting lip the sheet-like material 1 is pressed onto the surface of the conveyor belt 10 in the aligned condition of the sheet-like material 1. After passage of the pressing element, the sheet held on the surface of the conveyor belt 10 passes a charging unit 14. An electrode 15, which gives the sheet-like material 1 a static charge and thus provides for its adhesion to the surface of the conveyor belt, is held in this charging unit 14 within a hood-like cover.

Figure 5:
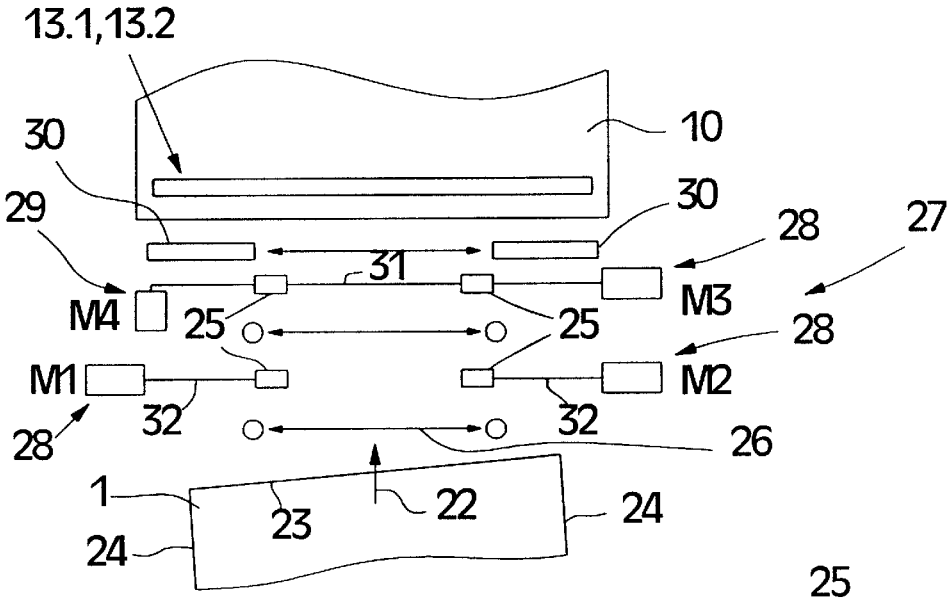
FIG. 5 shows the top view of the alignment components, the sensors, as well as the drive for the sheet-like material relative to the sheet direction of aligning rotation elements;.

The aligning unit 8, the components of which are shown in FIG. 5 is a schematic representation, and follows from the top view of FIG. 4. The aligning unit 8 is reached by the sheet-like material 1, which is conveyed in the conveying direction 22. The leading edge 23 of the sheet-like material 1 is offset in relation to the conveying direction 22 of the sheet-like material 1, which results in an oblique course of the side edges 24 of the sheet-like material 1. As soon as the leading edge 23 of the sheet lying in oblique position with respect to the conveying direction 22 passes over a first light barrier 26, the drives 27, designated as M1, M2, which drive rotation elements 25 over individual axes 32, are accelerated to advance speed. By the control of the drives 27, M1, or M2, released via the light barrier 26, it is assured that each copy of the sheet-like material 1 comes into contact with identical circumferential steps of the rotation elements 25, which can be made, for example, as segmented rollers. Any differences occurring in the advance motion, which could be attributed to dimension and shape tolerances of the two rotation elements 25, in this way appear in the case of each copy of the sheet-like material 1 and can be easily calibrated.

Figure 7:
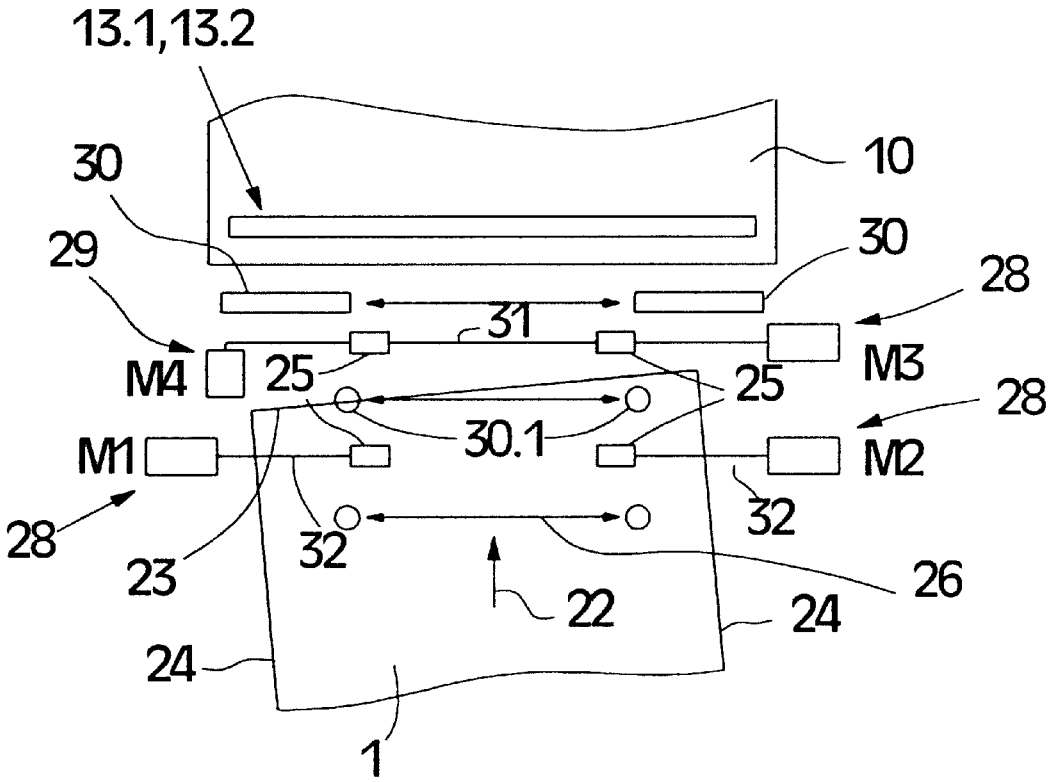
FIG. 7 shows the alignment of a sheet-like material with the drives of the segmented rollers performing the alignment.

After the two rotation elements 25 are set into rotation by passing the first light barrier 26, the sheet-like material 1 is transported over a further sensor unit 30.1 (FIG. 7) located after the first light barrier 26. As soon as the first of the two sensors of the sensor pair 30.1 has detected the leading edge 23 of the sheet-like material 1, a counting unit begins to count the motor steps. The counting process ends, and the difference is determined, when the second sensor of the sensor pair 30.1 switches on.

From the counter state determined in this way a contact value is determined which is given as an additional advance to the last started segmented roller drive; that is, either the drive 27, which is designated as M1, or the drive 27, which is designated as M2. In this way the rotation body 25, made correspondingly as a segmented roller, is moved with increased advance speed, until the predetermined path difference is completely compensated. At the end of this correction process the leading edge 23 of the sheer is oriented exactly perpendicular to the conveying direction 22.

After successful correction the sheet-like material 1 is transferred in the conveying direction 22 passing from the first pair of segmented rollers 25 to the following pair of bodies of rotation 25, which can be held on a common axis 31. Now the segmented roller pair 25 driven via drive 27, respectively M1 and M2, can be disengaged and a resting position is achieved.

The sheet-like material 1 now correctly aligned with respect to its angular position now passes onto a sensor field 30, in which the position of the side edges 24 of the sheet-like material 1 is measured. From the measured value determined a position change for the drive 27 is determined, which is designated as M4, the drive shaft of which extends parallel to the sheet travel direction 22. A correction of the position of the sheet-like material 1 parallel to its conveying direction 22 (see FIG. 7) by this drive 27 held in a second orientation 29.

The sheet-like material 1 oriented in its angular position and its lateral position passes under an adjusting flap or adjusting lip element set in a position 13.1 or 13.2 on the conveyor belt 10, in order to pass into the next printing unit in correctly oriented position. An embodiment of rotation element 25 located above the conveying plane 9, held in the aligning unit 8, follows from the representation according to FIG. 6. The rotation elements 25 can be made in preferred embodiment as segmented rollers, which have a peripheral surface 33 characterized by an interruption. The segmented rollers 25 rotate in the direction 34, characterized by the arrow shown and describe approximately a ¾ circle with respect to its rotation axis. A roller supporting the sheet-like material 1 is shown under the respective segmented roller 25. This can be in one part or also consist of a roller core 38, or a coating 35, 37, see FIG. 8.

Figure 6:
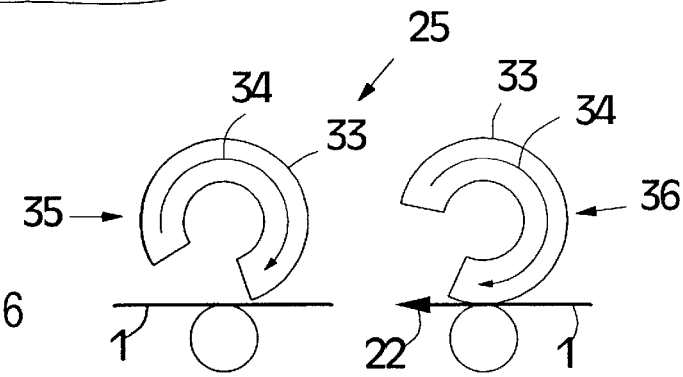
FIG. 6 shows the rotation elements made over the conveying plane of the sheet-like material as segmented rollers.

The bodies of rotation serving as segmented rollers 25 are shown in a resting position in the left-hand part of FIG. 6, while in the right-hand part of FIG. 6 they grip a copy of the sheet-like material 1 conveyed in the conveying direction 22 with its peripheral surface 33 and transport it corresponding to the direction of rotation 34 in the sheet travel direction 22. FIG. 5 shows the correction of the angular position of the sheet-like material 1 during the passage through the aligning unit 8. In the position of the sheet-like material 1 shown in FIG. 7, the leading edge thereof 23 just reaches the last sensor of the sensor pair 30.1, so that now the drive 27 of the segmented roller 25 designated as M1 can be accelerated, in order to compensate the angular position of the sheet-like material 1 with respect to the conveying direction 22. It should be mentioned that, as opposed to the drives M3 and M4, which are connected with one another via a continuous drive shaft 31, the segmented rollers 25, which are connected with drives M1 and M2, in each case are driven via individual shafts 32. After correction of the angular position of the sheet-like material 1 by controls of the respective drive 27 (M1 and M2) of the segmented rollers 25 with different speeds, the sheet-like material 1 experiences a correction of its lateral position. After the measurement of the position of the side edges 30 of the sheet-like material 1 by the sensors 31, the sheet-like material 1 now is oriented correctly parallel to the conveying direction 22, by moving the sheet like material 1 into its conveying plane before reaching the adjusting element and.before passing onto the conveyor belt 10 via the drive M4. The advance of the sheet-like material 1 is ensured via a common shaft 31, with drive M3, oriented in the first orientation 28 with a correctly aligned leading edge 23, while the latter is oriented in its later position via the drive 27, designated as M4, held in a second orientation 29.

Figure 8:
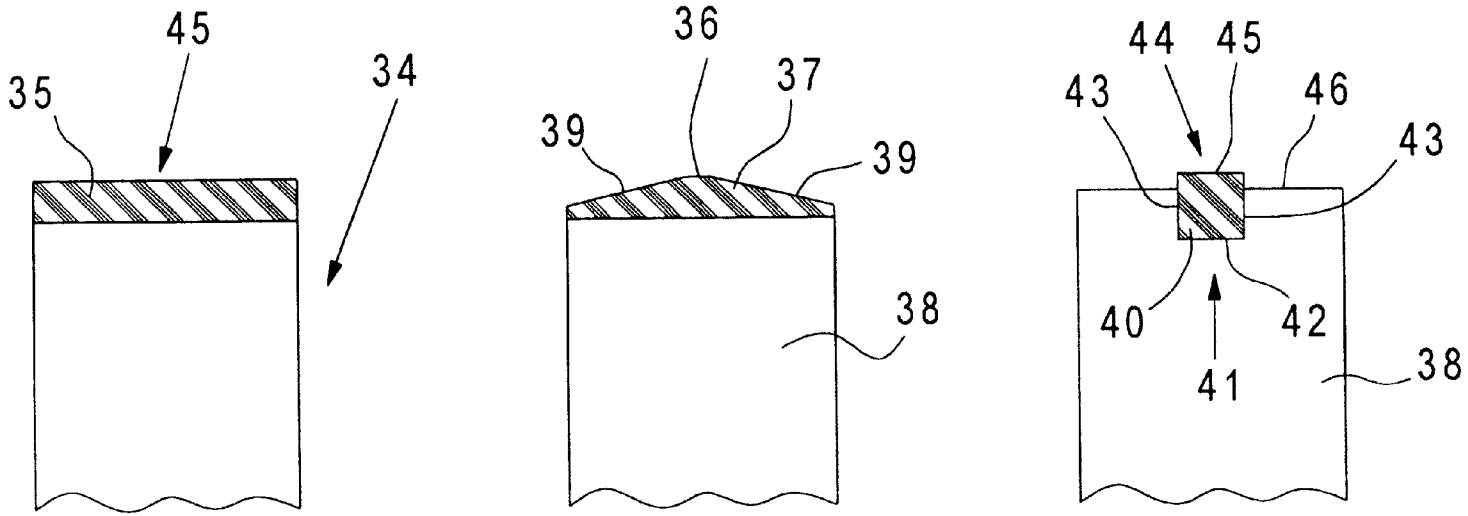
FIGS. 8*a*–8*c* shows the configuration of the segmented rollers aligning the sheet-like material proposed according to the invention.

The configuration of the segmented rollers, which can be made in two parts according than embodiment shown, follows from FIG. 8. The aligning elements made as segmented rollers 25 can be provided with a coating 35. A ring-like coating 35 with cylindrical contact surface 45 is shown in the embodiment according to FIG. 8*a*.

On the other hand, the embodiment shown in FIG. 8*b* has a roller core 38, onto the peripheral surface of which a trapezoidal coating 37 is mounted. The trapezoidal coating 37 can consist of rubber or of another elastic material and be applied in a self-locking form on the surface of the roller core 38 or also be cast on the latter. It can be simply glued or shrunk as an endless ring on the circumference. In order to increase the dimensional stability, the edges 39 of the trapezoidal coating 37 are made as attachments with a shallow inclination toward a contact area 36.

A bar-like contact area 36 extending in the peripheral direction of the trapezoidal coating 37 is made between the two edges 39. The point of contact between one side of the sheet-like material 1 and the surface of the contact area 36 can be held very small and defined very exactly by the narrow contact area, by which a sheet-like material 1 in each case to be aligned by the contact areas 36, since the turning point, around which the alignment is made, now is defined.

In the case of aligning elements with smooth cylinder surfaces of 35, the actual turning point of the sheet-like material is not known, the latter is found over the width of the roller core at the point on the contact surface 45, not defined more closely. As an alternative to a coating carrier made in ring-shape, which can also be applied onto the peripheral surface of a roller core 38, a coating element also can be held interlocking on the roller core 38. According to FIG. 8*c*, a ring-shaped recess 41 in the form of a longitudinal groove can be made on the peripheral surface of a roller core 38. The longitudinal groove is made out of a groove base 42 extending in each case in ring shape on the roller core 38 and bounded by two groove edges also extending in ring shape on the roller core 38. A rubber filling 40 or a ring-shaped, trapezoidal, rectangular, lozenge-shaped, or a cylindrically configured aligning element can be held in a recess on the circumference of the roller core 38 configured in this way. The walls 42 of the recess 41 supporting the side edges of an aligning element 40 configured in this way permit a high dimensional stability with the smallest possible width of the bearing surface 45 of the aligning element. This assures that in the case of the motions of the sheet-like material 1 and the aligning element 25 which occur, the contact surface 45 is not pushed out of the recess 41 during the lateral alignment of the sheet-like material. For this it is sufficient that according to the embodiment in FIG. 8*c*, the contact surface 45 projects by only a few tenths of a millimeter over the surface 46 of the roller core 38. By gripping the sheet-like material 1, the alignment elements 40 are slightly compressed, resulting in a smooth, continuous surface with the adjacent surface 46 of the roller core 38. The friction value which appears between the sheet-like material 1 and the surface of the aligning element 25 can be influenced by the choice of material for the aligning element, which is introduced into the recess 41 of the segmented roller core 38. The friction value on the underside must be less than the friction value which occurs between the upper side of the sheet-like material 1 and the peripheral surfaces 33 of the segmented rollers 25, so that an alignment relative to the counter-pressure elements supporting the sheet-like material 1 can take place by means of the segmented rollers.

Instead of an aligning element to be introduced into the surface of the roller core 38 itself also can be configured correspondingly, so that on the outermost end thereof there is a contact surface touching the upper side of the sheet-like material 1 linearly, which is causal for an exact alignment result.

The invention has been described in detail with particular reference to certain preferred embodiment thereof, but it will be understood that variations and modifications can be effected within the spirit and scope of the invention.

REFERENCE NUMBER LIST

1 sheet-like material
2 printing image
3 frame
4 position error y-direction
5 position error x-direction
6 twisting error
7 front side/rear side offset
8 aligning unit
9 conveying plane
10 conveyor belt
11 backup roller
12 control roller
13 adjusting element movement direction
13.1 $1^{st}$ position
13.2 $2^{nd}$ position
14 charging unit
15 electrode
16 support
17 leading edge sensor
18 radiation source
19 lens
20 radiation field
21 receiver
22 machine direction
23 leading edge
24 side edge
25 segmented roller
26 light barrier
27 segmented roller drive
28.1 drive orientation
28.2 drive orientation
30 sensor field
30.1 sensor pair
31 common shaft
32 individual shaft
33 segmented roller circumference
34 counter-pressure element
35 ring-shaped coating
36 contact area
37 trapezoidal coating
38 roller core
39 sides
40 rubber filling
41 groove
42 groove bottom
43 groove edges
44 bearing surface wideth
45 surface—roller core contact surface

I claim:

1. An alignment unit for sheet-like material (1), wherein such sheet-like material is aligned with respect to the conveying direction (22) through a machine processing such sheet-like material by rotation elements (25), (34) before passing to a conveying plane (9) and is contacted on at least one side of such sheet-like material by said rotation elements (25), (34), said rotation elements comprising: segmented rollers (25) respectively having a roller core (38) and a ring-shaped coating (35), said contact area between said segmented rollers (25), aligning such sheet-like material (1), and the sheet-like material (1) being minimized.

2. The aligning element according to claim 1, wherein said ring-shaped coating (35) is held on the peripheral surface of said roller core (38).

3. The aligning unit according to claim, 3 wherein said ring-shaped coating on said peripheral surface of the roller core (38) is self-locking.

4. The aligning unit according to claim 1, wherein said ring-shaped coating (35) is made in one piece.

5. The aligning unit according to claim 4, wherein said one piece ring-shaped coating is an elastic aligning element (40), and said roller core (38) has a recess (41) for receiving and holding said elastic aligning element (40).

6. The aligning unit according to claim 5, wherein said elastic aligning element (40) is flanked by lateral surfaces (43) of said recess (41).

7. The aligning unit according to claim 1, wherein said one piece ring-shaped coating (35) has a trapezoidal cross-section (37).

* * * * *